US008573991B2

(12) United States Patent
Kamiya

(10) Patent No.: US 8,573,991 B2
(45) Date of Patent: Nov. 5, 2013

(54) LEVER CONNECTOR

(71) Applicant: Yazaki Corporation, Tokyo (JP)

(72) Inventor: Jun Kamiya, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/863,864

(22) Filed: Apr. 16, 2013

(65) Prior Publication Data

US 2013/0224975 A1 Aug. 29, 2013

Related U.S. Application Data

(63) Continuation of application No. PCT/JP2011/072896, filed on Oct. 4, 2011.

(30) Foreign Application Priority Data

Oct. 18, 2010 (JP) ..... 2010-233820

(51) Int. Cl.
*H01R 13/62* (2006.01)

(52) U.S. Cl.
USPC ..... 439/157

(58) Field of Classification Search
USPC ..... 439/157, 159
See application file for complete search history.

(56) References Cited

U.S. PATENT DOCUMENTS

| | | | | |
|---|---|---|---|---|
| 6,264,485 | B1 * | 7/2001 | Saka et al. | 439/157 |
| 2001/0021600 | A1 * | 9/2001 | Kurimoto | 439/157 |
| 2001/0036758 | A1 * | 11/2001 | Osawa et al. | 439/157 |
| 2007/0167046 | A1 | 7/2007 | Shigeta et al. | |

FOREIGN PATENT DOCUMENTS

| | | | |
|---|---|---|---|
| JP | 3019279 | U | 10/1995 |
| JP | 2001-118631 | A | 4/2001 |
| JP | 2003-115356 | A | 4/2003 |
| JP | 2003-223955 | A | 8/2003 |
| JP | 2003-297481 | A | 10/2003 |
| JP | 2007-193998 | A | 8/2007 |
| JP | 2008-186598 | A | 8/2008 |
| JP | 2008-226535 | A | 9/2008 |

OTHER PUBLICATIONS

International Search Report and Written Opinion of the International Search Report for PCT/JP2011/072896 dated Nov. 8, 2011.

* cited by examiner

*Primary Examiner* — Phuong Dinh
(74) *Attorney, Agent, or Firm* — Kenealy Vaidya LLP

(57) ABSTRACT

A lever connector includes a housing, and a lever rotatably provided on the housing to be rotated in a locking direction to be disposed at a connection locking position. The lever includes support plate portions rotatably supported by both sides of the housing, each support plate portion has a protrusion portion protruding toward a side of the housing, the both sides of the housing have groove portions with which the protrusion portions of the lever at the connection locking position are engaged, each groove portion has a tapered surface inclined in a protruding direction of a protrusion portion as extending in the locking direction of the lever, and as the protrusion portions are slid along the tapered surfaces to be engaged with the tapered surfaces, respectively, the lever is applied with a rotating force in the locking direction.

1 Claim, 10 Drawing Sheets

LEVER CONNECTOR

CROSS REFERENCE TO RELATED APPLICATION

This application is a continuation of PCT application No. PCT/JP2011/072896, which was filed on Oct. 4, 2011 based on Japanese Patent Applications No. 2010-233820 filed on Oct. 18, 2010, the contents of which are incorporated herein by reference. Also, all the references cited herein are incorporated as a whole.

TECHNICAL FIELD

The present invention relates to a lever connector which is connected to a connection counterpart by rotating a lever.

BACKGROUND ART

In recent years, there has been used a lever connector which can be connected to or disconnected from a connector of a connection counterpart by a rotating force which is caused by rotating a lever, with a low insertion force. The lever connector includes a lock means for maintaining a connection state by locking the lever in a state where the lever connector is connected to the connector of the connection counterpart (see Patent Documents 1 to 3).

CITATION LIST

Patent Document

Patent Document 1: JP-A-2007-193998

Patent Document 2: JP-A-2008-226535

Patent Document 3: JP-A-2003-297481

SUMMARY OF INVENTION

Technical Problem

Incidentally, a clearance is formed between the lever connector and a housing in the state where the lever is locked by the lock means. For this reason, if the lever connector is used as a connection for a wire harness of a vehicle such as an automobile, the lever may rattle due to vibration or thermal stress when the vehicle is driven. Thus, a lock portion is worn or damaged, and thus the lock state is released, so that connection defect may arise.

In the connector disclosed in Patent Document 3, since the lever is biased in one direction by a spring, a rattling of the lever is prevented, and the wearing and damage of the lock portion due to the rattling of the lever can be suppressed. However, since an expensive spring is employed, it causes a cost increase.

The present invention has been made in view of the above-described circumstances, and an object of the present invention is to provide a lever connector which can improve reliability of connection with a low cost.

Solution to Problem

The above-described object is achieved by the following configuration.

(1) A lever connector comprises:

a housing configured to be connected to a connected section; and a lever rotatably provided on the housing and configured to be rotated in a locking direction which is one direction to be disposed at a connection locking position, so that the connected section and the housing are pulled to each other to connect terminals of the connected section and the housing with each other, wherein:

the lever includes support plate portions rotatably supported by both sides of the housing and a connecting portion connecting the support plate portions, each support plate portion is formed with a protrusion portion protruding toward a corresponding side of the housing, the both sides of the housing are formed with groove portions with which the protrusion portions of the lever disposed at the connection locking position are engaged, respectively, each groove portion has a tapered surface gradually inclined in a protruding direction of a corresponding protrusion portion as extending in the locking direction of the lever, and as the protrusion portions are slid along the tapered surfaces to be engaged with the tapered surfaces, respectively, the lever is applied with a rotating force in the locking direction, so that the connecting portion abuts against the housing.

In the lever connector having the configuration of (1), the protrusion portion of the lever is slid along the tapered surface of the groove portion of the housing, and is always disposed on the tapered surface to engage with the taper surface, so that the rotating force is kept being applied to the lever in the locking direction. Therefore, the connecting portion of the lever abuts against the housing, thereby eliminating a clearance between the lever and the housing in the state where the lever is locked to the housing.

Therefore, even if the lever connector is used as a connection for a wire harness of a vehicle such as an automobile, it is possible to prevent rattling of the lever due to vibration or thermal stress when the vehicle is driven. The lock portion is suppressed from being worn or damaged due to the rattling, thereby maintaining a reliable connection state between the terminals.

That is, as compared with the configuration employing an expensive spring to prevent the rattling, the reliability of connection can be improved with a low cost.

DESCRIPTION OF EMBODIMENT

An embodiment of the present invention will now be described with reference to the accompanying drawings.

Figure 1:
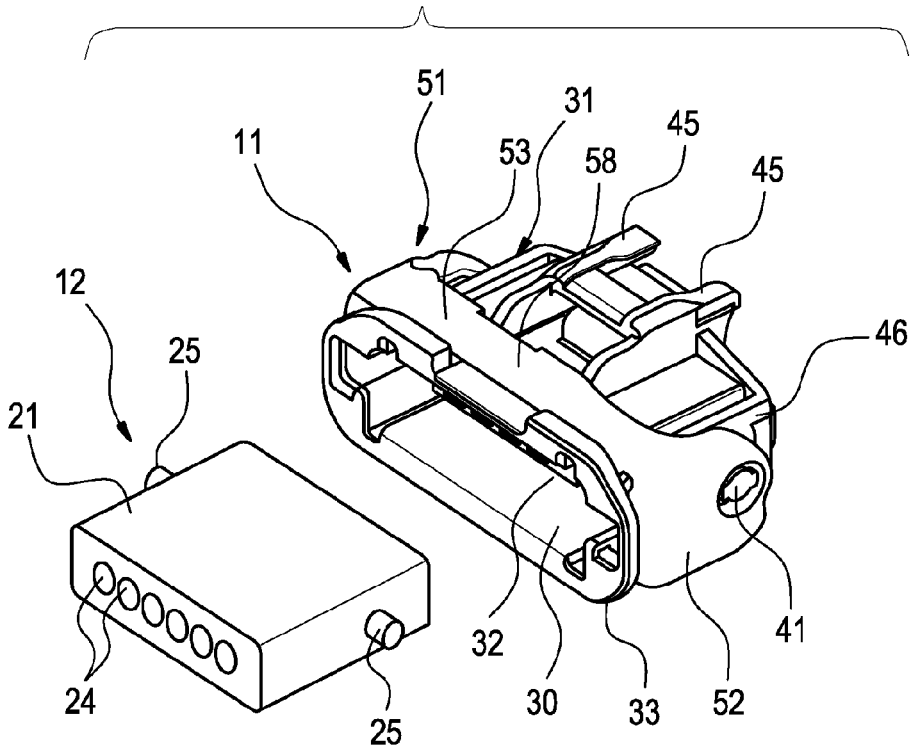
FIG. 1 is a perspective view illustrating an appearance of a lever connector according to an embodiment, when seen from a front side of the lever connector.
Figure 2:
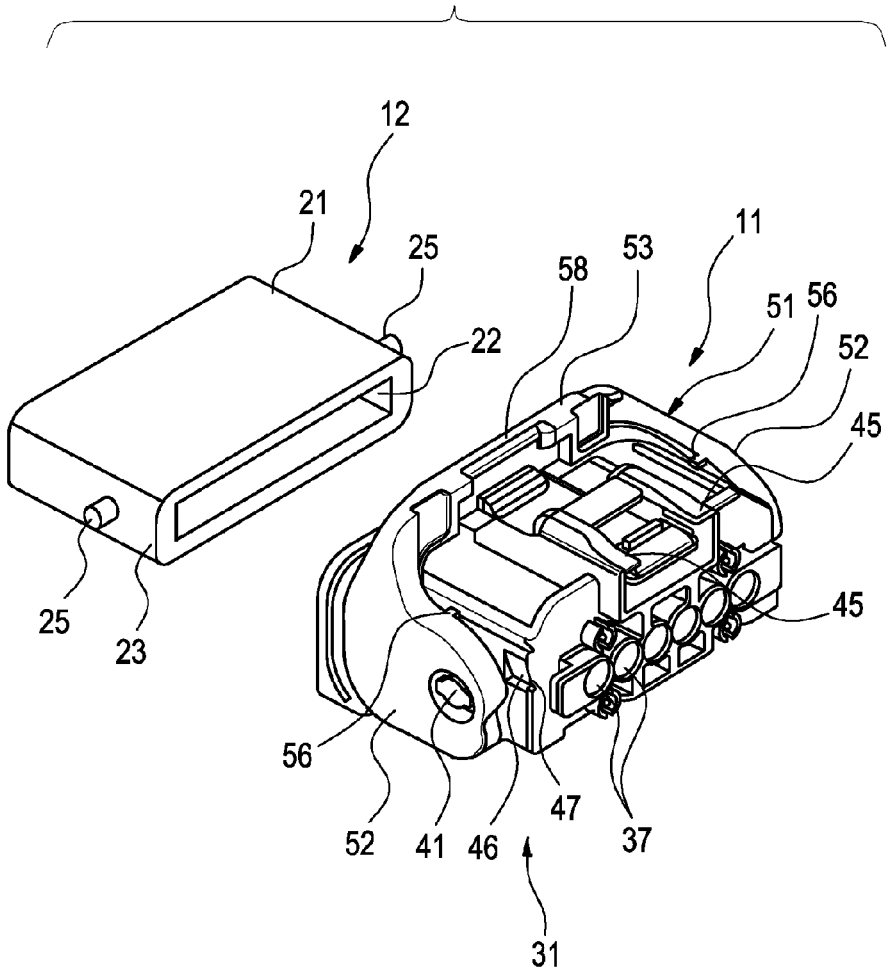
FIG. 2 is a perspective view illustrating an appearance of the lever connector according to the embodiment, when seen from a rear side of the lever connector.
Figure 3:
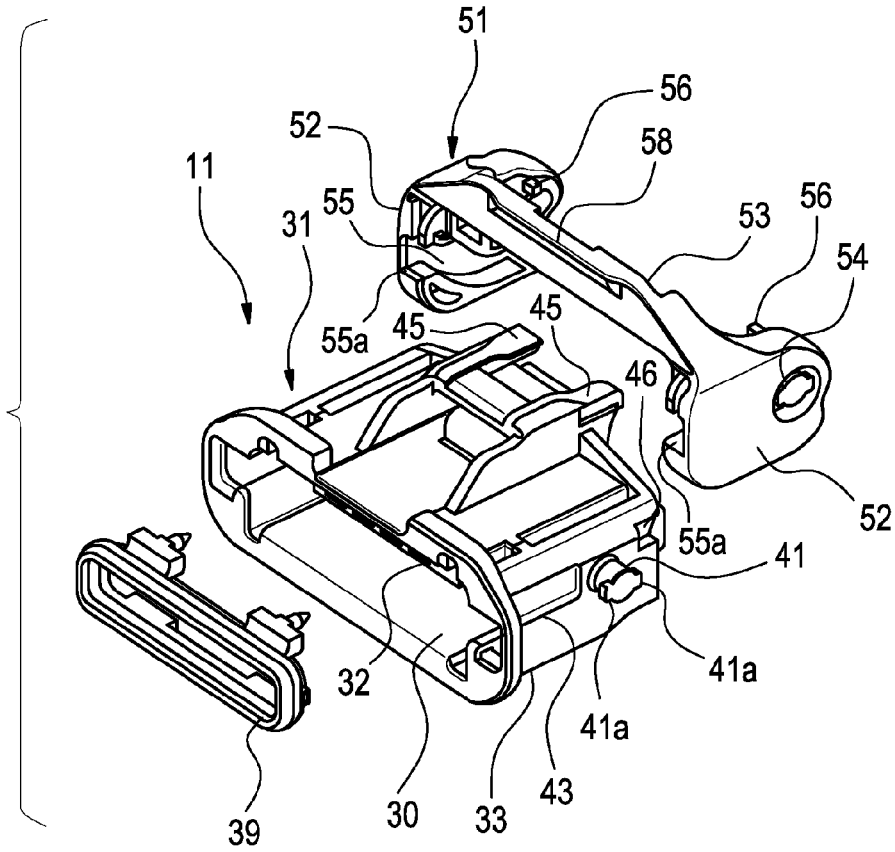
FIG. 3 is an exploded perspective view illustrating the configuration of the lever connector according to the embodiment.
Figure 4:
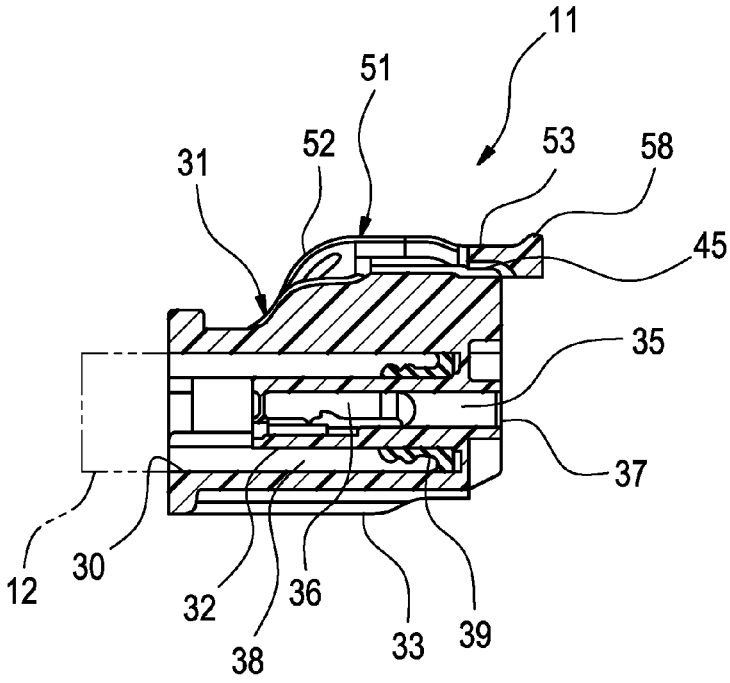
FIG. 4 is a cross-sectional view illustrating an internal structure of the lever connector according to the embodiment.
Figure 5:
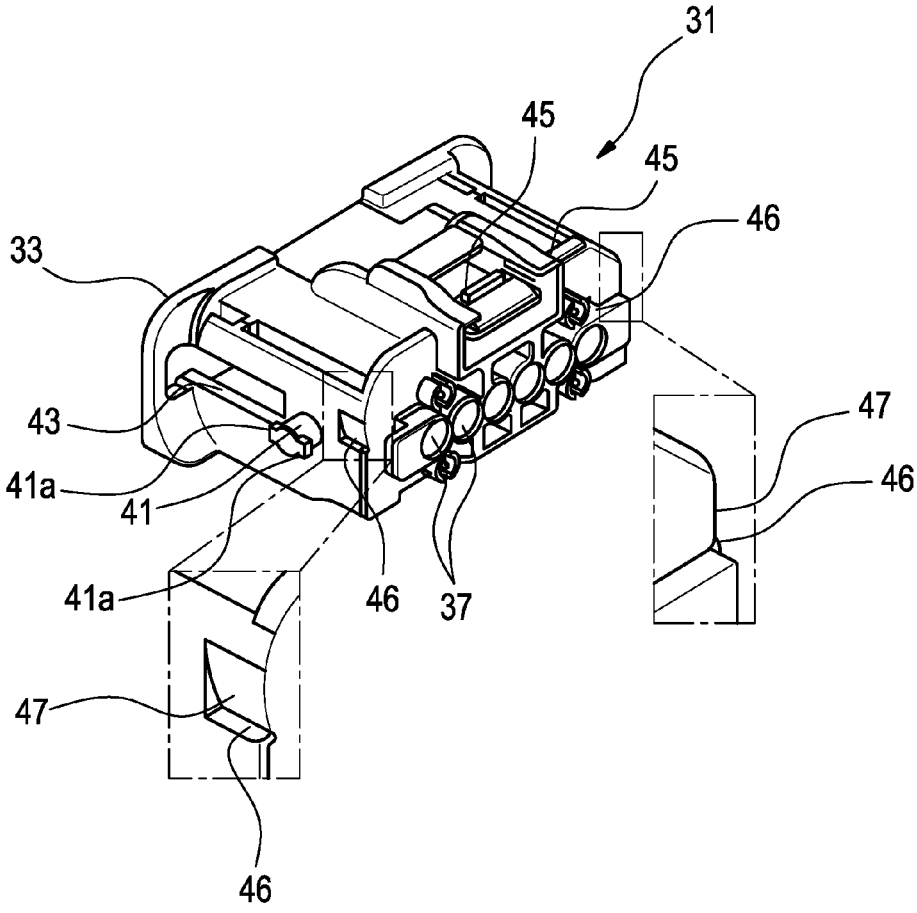
FIG. 5 is a perspective view and a partially enlarged perspective illustrating the structure of a connector housing configuring the lever connector, when seen from a rear side of the connector housing.
Figure 6:
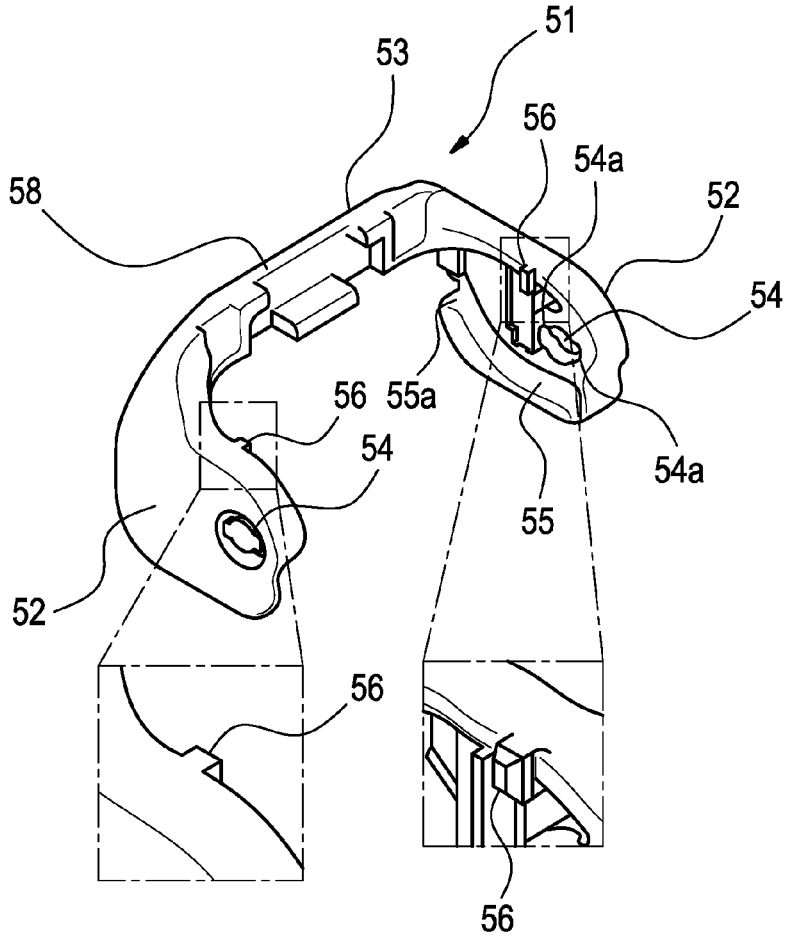
FIG. 6 is a perspective view and a partially enlarged perspective illustrating the structure of a lever configuring the lever connector, when seen from a rear side of the lever.

FIG. 1 is a perspective view illustrating an appearance of a lever connector according to an embodiment, when seen from a front side of the lever connector, FIG. 2 is a perspective view illustrating an appearance of the lever connector according to the embodiment, when seen from a rear side of the lever connector, FIG. 3 is an exploded perspective view illustrating the configuration of the lever connector according to the embodiment, FIG. 4 is a cross-sectional view illustrating an internal structure of the lever connector according to the embodiment, FIG. 5 is a perspective view and a partially enlarged perspective illustrating the structure of a connector housing configuring the lever connector, when seen from a rear side of the connector housing, and FIG. 6 is a perspective view and a partially enlarged perspective illustrating the structure of a lever configuring the lever connector, when seen from a rear side of the lever.

As illustrated in FIGS. 1 and 2, a lever connector 11 according to this embodiment is connected to a receptacle 12 which is a connected section.

The receptacle 12 includes a housing 21 formed by a synthetic resin, and the housing 21 accommodates male terminals (not illustrated) spaced apart from each other in a width direction at a regular interval therein. The housing 21 is formed with a hood portion 23 having a fitting hole 22 at a side connected with the lever connector 11. The housing 21 is provided with a plurality of through-holes 24 at a side opposite to the side connected with the lever connector 1, and electric wires connected to the male terminals accommodated in the housing 21 pass through the through-holes 24. Further, the housing of the receptacle 12 is formed with cylinder-shaped guide bosses 25 at both sides of the hood portion 23.

As illustrated in FIGS. 3 and 4, the lever connector includes a connector housing (housing) 31 formed by a synthetic resin. The connector housing 31 is mounted with a lever 51 formed by a synthetic resin.

The connector housing 31 is formed with an opening 30 at a front end side thereof, and the receptacle 12 is inserted in the opening 30. The connector housing 31 has an inner housing 32 and an outer cover 33 provided integrally to enclose the inner housing 32. The inner housing 32 and the outer cover 33 are connected to each other at a rear end side opposite to the side connected with the receptacle 12.

The inner housing 32 is formed with a plurality of cavities 35 spaced apart from each other at a regular interval in the width direction, and female terminals (terminal) 36 are accommodated in these cavities 35.

As illustrated in FIG. 5, the connector housing 31 is formed with a plurality of through-holes 37, and electric wires connected to the female terminals 36 accommodated in the connector housing 31 pass through these through-holes 37.

In the connector housing 31, a gap 38 is formed between the inner housing 32 and the outer cover 33. The hood portion 23 of the receptacle 12 is inserted into the gap 38.

Further, the connector housing 31 is mounted with a packing 39 inside the gap 38 between the inner housing 32 and the outer cover 33, and when the hood portion 23 of the receptacle 12 is inserted into the gap 38, the packing 39 seals a space between the hood portion 23 and the gap 38.

The connector housing 31 is provided with lever support shafts 41 at both sides thereof. These lever support shafts 41 protrude from an outer surface of the connector housing 31, and are formed in a substantially cylindrical shape. Each lever support shafts 41 is formed with claw portions 41*a* at a tip end thereof which protrude toward an outside in a diameter direction.

Further, the connector housing 31 is formed with slits 43 at both sides thereof, and the slit 43 extends from the opening 30 to a middle portion near the lever support shaft 41 along a front-rear direction. The guide bosses 25 formed on the receptacle 12 are inserted into the respective slits 43 and are slid along the slits 43.

The upper surface of the connector housing 31 is provided with a lever abutting portion 45 at a rear end thereof, and an operation portion 58, which will be described later, of the lever 51 abuts against the lever abutting portion 45.

Further, the connector housing 31 is formed with lock grooves (groove portion) 46 at the rear ends of both sides thereof. These lock grooves 46 have tapered surfaces 47, respectively. The tapered surface 47 is gradually inclined toward an inside of the connector housing 31 which is a protruding direction of a lock protrusion (protrusion portion) 56 of a lever 51 (will be described later) as extending in a lower direction which is a locking direction of the lever 51 (will be described later).

As illustrated in FIG. 6, the lever 51 mounted on the connector housing 31 has a pair of plate-shaped support plate portions 52 disposed at an interval, and a connecting portion 53 connecting circumferential portions of the support plate portions 52, and is formed in a substantially U-shape as a whole.

Each support plate portion 52 is formed with a fulcrum opening 54, and the fulcrum opening 54 is formed with concave portions 54*a* at opposite positions. The lever support shaft 41 passes through the fulcrum openings 54 in a state where the claw portions 41*a* are aligned with the concave portions 54*a*. Thus, the lever 51 is mounted in the connector housing 31 such that the lever 51 can rotate around an axis of the lever support shaft 41 passing through the fulcrum openings 54.

The claw portion 41*a* of the lever support shaft 41 is disposed at an outer surface side of the support plate portion 52 than the fulcrum opening 54. Therefore, as the claw portions 41*a* engage with the outer surface sides of the support plate portions 52, the lever support shaft 41 is prevented from being released from the fulcrum openings 54 of the lever 51 when the lever 51 rotates.

Further, each support plate portion 52 of the lever is formed with a guide groove 55 at a facing surface side thereof. The guide groove 55 has one end disposed near the lower portion of the fulcrum opening 54 and the other end gently curved and extended toward a front end side of the connector housing 31. The guide groove 55 has a width slightly larger than a diameter of the guide boss of the receptacle 12, and thus the guide boss 25 inserted into the slit 43 of the connector housing 31 can be accommodated in the guide groove 55.

The guide groove 55 is opened at the other end thereof, and the opened other end becomes an insertion hole 55*a*. In the state where the lever 51 rotates toward the front end side of the connector housing 31, the insertion hole 55*a* of the guide groove 55 is disposed at a position which is overlapped with the slit 43 of the connector housing 31, and the guide boss 25 of the receptacle 12 inserted into the slit 43 is also inserted into the guide groove 55 through the insertion hole 55*a*.

Each support plate portion 52 of the lever 51 is formed with a lock protrusion 56 protruding toward the side of the connector housing 31. These lock protrusions 56 are configured to engage with the lock grooves 46 of the connector housing 31.

The lever 51 is configured such that the connecting portion 53 functions as the operation portion 58, and the operation portion 58 can be rotated with respect to the connector housing 31 by holding the operation portion 58.

Figure 7:
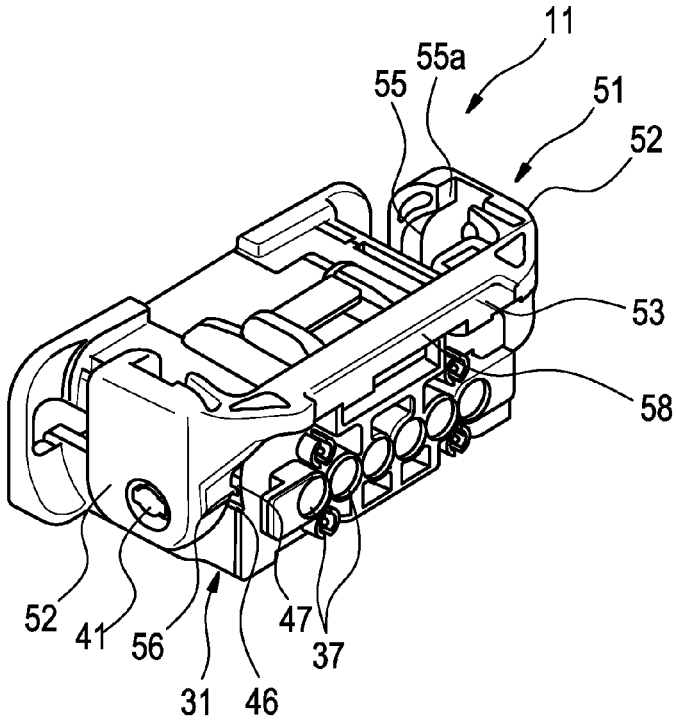
FIG. 7 is a perspective view illustrating the lever connector in a lock state, when seen from a rear side of the lever connector.

For the lever 51, the position where the operation portion 58 is disposed at the front end side of the connector housing 31 and thus the insertion hole 55*a* of the guide groove 55 is overlapped with the slit 43 is regarded as a connectable position (position illustrated in FIGS. 1 and 2), and the position where the operation portion 58 is disposed at the rear end side of the connector housing 31 and the lock protrusion 56 is engaged with the lock groove 46 is regarded as a connection locking position (position illustrated in FIGS. 4 and 7).

Next, the case where the lever connector 11 is connected to the receptacle 12 will be described.

First, the receptacle 12 is inserted into the opening 30 of the connector housing 31 of the lever connector 11 in the state where the lever 51 is disposed at the connectable position.

In this manner, the hood portion 23 of the receptacle 12 is covered by the inner housing 32, and the guide boss 25 of the receptacle 12 is inserted into the slit 43 of the connector housing 31. Further, the guide boss 25 of the receptacle 12 is also inserted into the guide groove 55 through the insertion hole 55*a*.

In this state, the operation portion 58 of the lever 51 is held, and then the operation portion 58 is moved in the locking direction which is a direction toward the rear end side of the connector housing 31. That is, the lever 51 is rotated around the lever support shaft 41. Then, the position where the guide groove 55 is overlapped with the slit 43 is moved toward the lever support shaft 41, and thus the guide boss 25 of the receptacle 12 inserted into both the slit 43 and the guide groove 55 is moved toward the rear end side of the connector housing 31 which is a side of the lever support shaft 41, along the longitudinal direction of the connector housing 31. Accordingly, the receptacle 12 is pulled toward the lever connector 11.

As illustrated in FIG. 7, if the operation portion 58 of the lever 51 is moved to the connection locking position, the inner housing 32 is fitted in the fitting hole 22 of the receptacle 12, and thus the hood portion 23 is inserted into the gap 38, so that the female terminal 36 of the inner housing 32 is connected to the male terminal of the receptacle 12 to electrically connect the electric wires. Further, the packing 39 seals a space between the hood portion 23 of the receptacle 12 and the gap 38, and thus the connecting portion between the female terminal 36 and the male terminal is sealed.

In this state, the lever 51 takes a locking state where the lock protrusion 56 reaches the lock groove 46, and the lock protrusion 56 is engaged with the lock groove 46, so that the lever is locked to the connector housing 31. Therefore, the lever connector 11 is maintained in the state where it is reliably connected to the receptacle 12.

Figure 8:
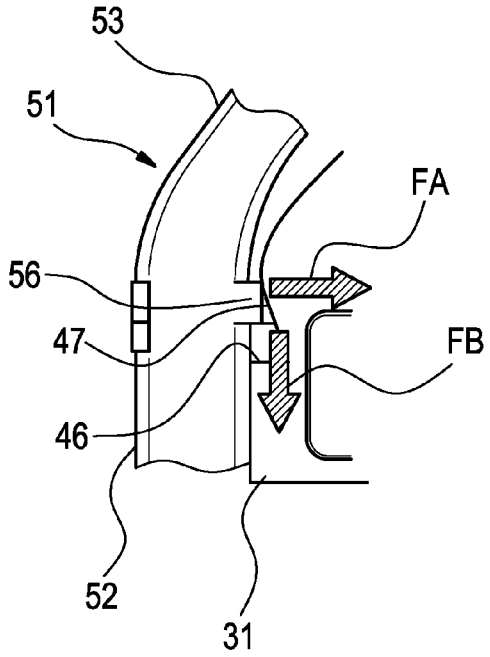
FIG. 8 is a side view of a lock portion to illustrate an engaging state of a lock groove and a lock protrusion.

Further, in the locking state, as illustrated in FIG. 8, the lock protrusion 56 of the lever 51 is pressed against the tapered surface 47. Therefore, a pressing force FA of the lock protrusion 56 against the tapered surface 47 is dispersed and a force component FB operates as a rotating force to further rotate the lever 51 in the locking direction. Accordingly, the lever 51 further rotates in the locking direction, and thus the operation portion 58 of the lever 51 abuts against the lever abutting portion 45 of the connector housing 31 in a pressed state.

Figure 9:
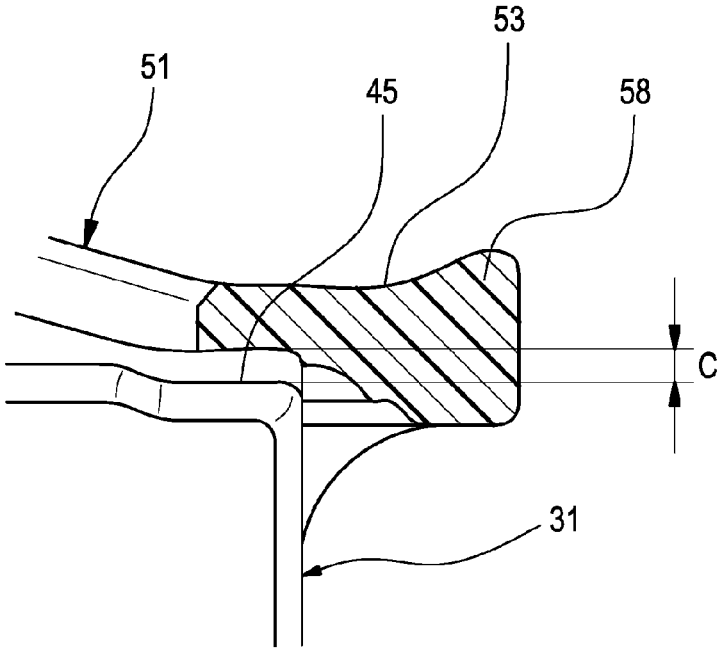
FIG. 9 is a side view illustrating a positional relation between a lever abutting portion of the connector housing and an operation portion of the lever.
Figure 10:
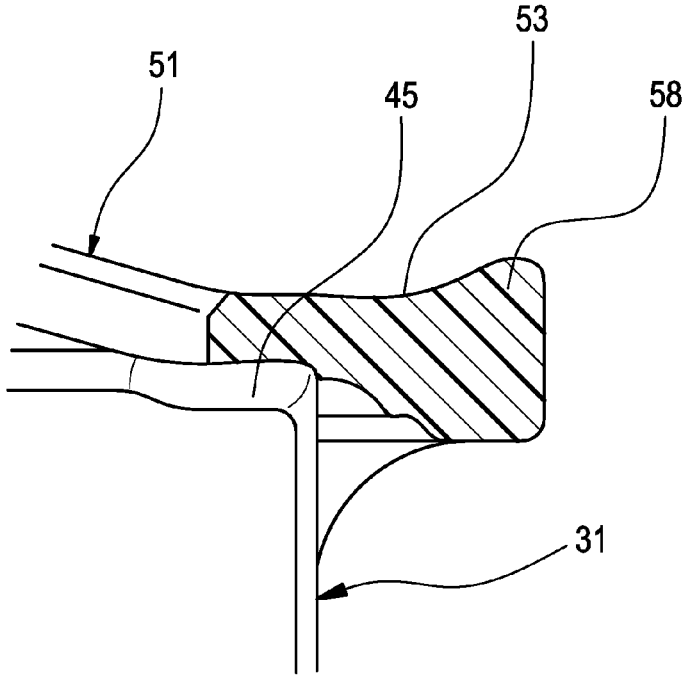
FIG. 10 is a side view illustrating a positional relation between the lever abutting portion of the connector housing and the operation portion of the lever.

That is, when the operation portion 58 of the lever starts to engage with the lock groove 46 of the lock protrusion 56, as illustrated in FIG. 9, the operation portion 58 has a clearance C with respect to the lever abutting portion 45. However, the lock protrusion 56 enters the lock groove 46, and then abuts against the tapered surface 47 to slide on the tapered surface. Therefore, the lock protrusion 56 is engaged with the tapered surface 47, and thus the operation portion 58 of the lever 51 is pressed against the lever abutting portion 45 without the clearance C, as illustrated in FIG. 10.

To disconnect the lever connector 11 connected to the receptacle 12 as described above, the operation portion 58 of the lever 51 in the locking state is held, and then the lever 51 is moved to the front end side of the connector housing 31. Then, the lock protrusion 56 is released from the lock groove 46, so that the locking of the lever 51 is released.

Further, if the lever 51 rotates around the lever support shaft 41 in an unlocking direction which is the front side of the connector housing 31, the position where the guide groove 55 is overlapped with the slit 43 is moved to be spaced apart from the lever support shaft 41, and thus the guide boss 25 of the receptacle 12 inserted into both the slit 43 and the guide groove 55 is moved toward the front end side of the connector housing 31 which is opposite to the lever support shaft 41, along the longitudinal direction of the connector housing 31. Accordingly, the receptacle 12 is released from the lever connector 11, so that the connection between the female terminal 36 of the inner housing 32 and the male terminal of the receptacle 12 is released.

In the lever connector according to the embodiment, the lock protrusion 56 of the lever 51 is slid along the tapered surface 47 of the lock groove 46 of the connector housing 31, and is always disposed on the tapered surface to engage with the taper surface 47, so that the rotating force is kept being applied to the lever 51 in the locking direction. Therefore, the operation portion 58 configured by the connecting portion 53 of the lever 51 abuts against the lever abutting portion 45 of the connector housing 31, thereby eliminating the clearance C between the operation portion 58 of the lever 51 and the lever abutting portion 45 of the connector housing 31 in the state where the lever 51 is locked to the connector housing 31.

Therefore, even if the lever connector is used as a connection for a wire harness of a vehicle such as an automobile, it is possible to prevent rattling of the lever 51 due to vibration or thermal stress when the vehicle is driven. The lock portion formed by the lock protrusion 56 and the lock groove 46 is suppressed from being worn or damaged due to the rattling, thereby maintaining the reliable connection state between the terminals.

That is, as compared with the configuration employing an expensive spring to prevent the rattling, the reliability of connection can be improved with a low cost.

The invention is not limited to the embodiment that has been described heretofore but can be modified or improved as required. In addition, the material, shape, dimensions, number and locations of the individual constituent elements of the embodiment are arbitrary and hence are not limited to those described in the embodiment, provided that the invention can be attained.

While the present invention has been described with respect to the specific embodiments, it will be apparent to those skilled in the art that various changes and modifications may be made without departing from the spirit and scope of the invention.

This application claims priority to Japanese Patent Application No. 2010-233820, filed on Oct. 18, 2010, which is incorporated herein by reference in its entirety.

INDUSTRIAL APPLICABILITY

The present invention can provide a lever connector which can improve reliability of connection with a low cost.

DESCRIPTION OF REFERENCE NUMERALS

11 lever connector
12 receptacle (connected section)
31 connector housing (housing)
36 female terminal (terminal)
46 lock groove (groove portion)
47 tapered surface
51 lever
52 support plate portion
53 connecting portion
56 lock protrusion (protrusion portion)

What is claimed is:

1. A lever connector comprising:

a housing configured to be connected to a connected section; and a lever rotatably provided on the housing and configured to be rotated in a locking direction which is one direction to be disposed at a connection locking position, so that the connected section and the housing are pulled to each other to connect terminals of the connected section and the housing with each other, wherein:

the lever includes support plate portions rotatably supported by both sides of the housing and a connecting portion connecting the support plate portions, each support plate portion is formed with a protrusion portion protruding toward a corresponding side of the housing, the both sides of the housing are formed with groove portions with which the protrusion portions of the lever disposed at the connection locking position are engaged, respectively, each groove portion has a tapered surface gradually inclined in a protruding direction of a corresponding protrusion portion as extending in the locking direction of the lever, and as the protrusion portions are slid along the tapered surfaces to be engaged with the tapered surfaces, respectively, the lever is applied with a rotating force in the locking direction, so that the connecting portion abuts against the housing.

* * * * *